US005472084A

United States Patent [19]

Aliano, Jr.

[11] Patent Number: 5,472,084

[45] Date of Patent: Dec. 5, 1995

[54] PIGGYBACK GOLF BAG

[76] Inventor: Joseph F. Aliano, Jr., 116 McClellan St., Philadelphia, Pa. 19148

[21] Appl. No.: 277,397

[22] Filed: Jul. 19, 1994

[51] Int. Cl.[6] ..... A63B 55/00

[52] U.S. Cl. ..... 206/315.3; 190/108

[58] Field of Search ..... 190/108; 206/315.3, 206/315.5, 315.8; 224/911

[56] References Cited

U.S. PATENT DOCUMENTS

| | | | |
|---|---|---|---|
| 1,628,771 | 5/1927 | Frisk | 206/315.3 X |
| 3,373,911 | 3/1968 | Kebelbeck | 206/315.3 X |
| 4,350,194 | 9/1982 | Brown | 206/315.5 |
| 4,408,706 | 10/1983 | Hurley | 224/911 X |
| 4,744,446 | 5/1988 | Arney | 190/108 |
| 4,779,725 | 10/1988 | Gerber | 206/315.3 |
| 4,836,343 | 6/1989 | Arney | 190/108 |
| 4,869,365 | 9/1989 | Perdue et al. | 206/315.5 |
| 4,924,682 | 5/1990 | Penner | 206/315.3 X |
| 4,984,684 | 1/1991 | Conner et al. | 206/315.3 |
| 5,080,239 | 1/1992 | Rowland | 211/70.2 |
| 5,096,059 | 3/1992 | Henderson | 206/315.5 |
| 5,112,068 | 5/1992 | Liao et al. | 206/315.3 X |
| 5,197,525 | 3/1993 | Cantor | 190/108 X |
| 5,269,410 | 12/1993 | Abregano | 206/315.3 |

*Primary Examiner*—Stephen J. Castellano
*Assistant Examiner*—Christopher J. McDonald
*Attorney, Agent, or Firm*—Frank M. Linguiti

[57] ABSTRACT

Briefly stated, the present invention comprises a piggyback golf bag for use in a riding golf cart having a golf cart attachment device for attaching the golf bag to the golf cart. The piggyback golf bag includes a first golf bag portion and a second golf bag portion. The first golf bag portion has an opening for receiving a golf club and a body portion for retaining a golf club. The second golf bag portion, which is separate from the first golf bag portion, also has an opening for receiving a golf club and a body portion for retaining a golf club. A golf bag attachment device is provided for detachably securing the first and second golf bag portions to each other.

44 Claims, 9 Drawing Sheets

PIGGYBACK GOLF BAG

BACKGROUND OF THE INVENTION

The present invention relates generally to a golf club bag for use with a riding golf cart and, in particular, a golf club bag which permits more convenient transporting of selected golf clubs to the location of a shot distant from the golf cart.

A great deal of attention has been paid to the design of both golf carts and golf bags, in order to enable them to assist golfers in enjoying their game. The basic use of a golf bag is carrying a set of golf clubs and related smaller golf accessories. Presently many different types of golf bags are available to serve these basic purposes. The most common type of golf bag available is formed with an elongated, generally cylindrical body portion with a closed bottom. The top of the bag is open in order to allow golf clubs to be inserted handle first into the elongated body portion of the golf bag. A shoulder strap is adjustably fixed along one longitudinal side of the golf bag allowing it to be carried on the shoulder of the golfer. Several pockets are usually provided about the periphery of the golf bag for storage of the smaller golf accessories such as golf balls and tees. Larger pockets are sometimes also provided on golf bags for storage of other items such as clothing in order to make it easier for the user to change clothes when desired.

Riding golf carts provide convenient transportation for golfers as well as golf bags, golf clubs and any other items golfers may wish to bring along while playing a game of golf. Most riding golf carts are used on golf courses by pairs of golfers with their golf bags strapped to the back of the golf cart. When playing a game of golf one golfer may hit a ball to one side of a fairway and another golfer may hit a ball to the other side. Thus, one golfer may have to walk to one of the balls while the other golfer drives the golf cart to the other ball. Sometimes a golf ball may be hit to an area of the golf course where a golf cart cannot be driven. Additionally, golf carts are often restricted to limited areas of golf courses such as golf cart paths particularly in the vicinity of the greens.

Thus, there are several reasons why it may be sometimes necessary for a golfer to leave the golf cart and carry one or more clubs to an area where a ball has been hit where it is not possible to drive the cart. In situations like these the golfer leaving the golf cart normally removes one or more clubs from a golf bag and hand carries them to the location of the ball. Thus, it is desirable to have a convenient way for the golfer to carry the golf clubs under these circumstances.

Often a golfer who carries clubs to the ball is not sure which club will be needed. Therefore, golfers often carry a number of different clubs with them when they leave the cart. For example, in the vicinity of a green a golfer often carries one or more short irons and a putter to the location of the ball. While making the shot the golfer usually lays the unused clubs on the ground. The unused clubs are then retrieved when the shot is completed. This can cause problems because the clubs are sometimes inadvertently left behind on the ground when the golfer completes playing the hole and returns to the golf cart.

When this happens it may be difficult to find the golf clubs inadvertently left behind. Sometimes the clubs may be left in tall grass making them more difficult to find later when it is determined that they are missing. The same problem may occur in the vicinity of the green when the golfer utilizes the putter and leaves another club, such as a short iron, in the approaches or fringes of the green. Placing unused golf clubs on the ground also exposes them to moisture and dirt thereby requiring the golfer to clean them before they can be used.

While no statistics are believed to be available on this problem, it is believed that many golfers who use golf carts have inadvertently left a golf club somewhere on a golf course in this manner. Many golfers have made this same mistake more than once. Therefore it is desirable to find a way to prevent the accidental loss of golf clubs in this manner. Additionally, it is desirable to make the carrying of a number of golf clubs away from golf carts more convenient for golfers.

Small hand carried golf club holders suitable for this purpose have been known and used for many years. Some of the known golf club holder devices provide a blade or spike protruding from one end of the holder. To use these club holder devices the golfer forces the blade or spike into the ground to support the club holder in an upright position while making a shot.

An early example of such a device is taught in U.S. Pat. No. 699,391 issued May 6, 1902, to Johnson. In the Johnson golf club holder the golf club shafts are retained at the top and bottom portions of the holder by laterally projecting discs and sockets. U.S. Pat. No. 2,577,333, issued Dec. 4, 1951, to Klum et al. also discloses retaining members at the top and bottom portions of the holder wherein the retaining members project outwardly to retain the club shafts. U.S. Pat. No. 2,716,432, issued Aug. 30, 1955, to Duffy teaches retaining the club shafts only at the top portion of the club holder. The club holder taught by Duffy is held upright by a laterally projecting spike.

U.S. Pat. No. 2,858,868, issued Nov. 4, 1958, teaches a rigid, laterally projecting retaining member positioned toward the top of the club holder for retaining the golf clubs. The head portions of the golf clubs are retained by a flexible strap which encircles the golf club shafts in this device. U.S. Pat. No. 2,887,137, issued May 19, 1959, to Robb discloses a laterally projecting slotted retainer to hold the grip portions of the golf clubs.

U.S. Pat. No. 5,080,239, issued Jan. 14, 1992, to Rowland teaches a golf club holder which is particularly adapted for use with golf carts. The Rowland device provides an elongated rigid body terminating at one end as a spike. The spike termination is driven into the ground when using the holder. The other end of the elongated body is provided with a handle for carrying the golf club holder device. A plurality of elongated flexible retaining members are fixed at one of their ends to the body. The other ends of the retaining members are affixed to a ring or other securing device which is effective to grasp a golf club shaft. When no golf clubs are retained in this golf club holder device, it may be conveniently inserted into a golf bag and carried along with a number of golf clubs.

It is also known to provide add-on devices for conveniently carrying small golf accessories or other objects along with golf bags. For example, U.S. Pat. No. 5,096,059, issued Mar. 17, 1992, to Henderson teaches an accessory saddle member for a golf bag. The accessory saddle member includes a number of closeable pockets for carrying golf related items and personal items. It is also provided with straps for securing the saddle member to the golf cart. The saddle member taught by Henderson may be detachably secured to a golf bag using a hook and loop fabric fastener strip when the golf bag is received into an aperture in the saddle member.

U.S. Pat. No. 5,269,410, issued Dec. 14, 1993, to Abregano teaches a golf accessory organizer. The golf accessory organizer taught by Abregano is adapted to hold a number of small accessories such as tees, divot fixers and ball markers. A spring clip is provided on the Abregano accessory organizer for releasably securing the accessory organizer to a golf bag. However, neither the accessory saddle member taught by Henderson nor the accessory organizer taught by Abregano is suitable for holding and carrying a plurality of golf clubs.

The present invention comprises a golf club bag for use in a riding golf cart. The riding golf cart has an attachment bar or other attachment means for attaching the golf bag to the back of a golf cart. The present golf club bag has two golf bag portions. Each golf bag portion has an opening at the top for receiving at least one golf club and an elongated body portion for retaining the shafts and grips of the golf clubs. The two golf bag portions are separate and a bag attachment device is provided for securely and detachably attaching the two golf bag portions to each other. One of the golf bag portions is attached to the golf cart in order to secure it while it is transported by the golf cart. The other golf bag portion attaches to the golf bag portion which is secured to the golf cart. When the two golf bag portions are detached from each other, each may be carried separately by its own carrying strap while retaining its own golf clubs.

SUMMARY OF THE INVENTION

Briefly stated, the present invention comprises a piggyback golf bag for use in a riding golf cart having a golf cart attachment device for attaching the golf bag to the golf cart. The piggyback golf bag includes a first golf bag portion and a second golf bag portion. The first golf bag portion has an opening for receiving a golf club and a body portion for retaining a golf club. The second golf bag portion, which is separate from the first golf bag portion, also has an opening for receiving a golf club and a body portion for retaining a golf club. A golf bag attachment device is provided for detachably securing the first and second golf bag portions to each other. The golf bag attachment device maintains the first and the second golf bag portions secured to each other while the golf cart attachment device secures one of the portions to the golf cart.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1A:
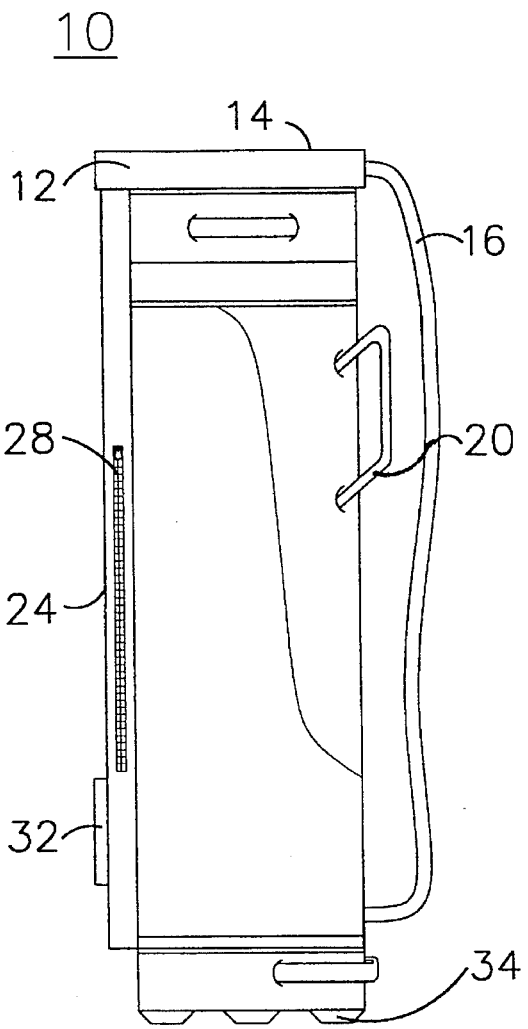
FIG. 1A is a side elevational view of a large golf bag portion of the piggyback golf bag system of the present invention.
Figure 1B:
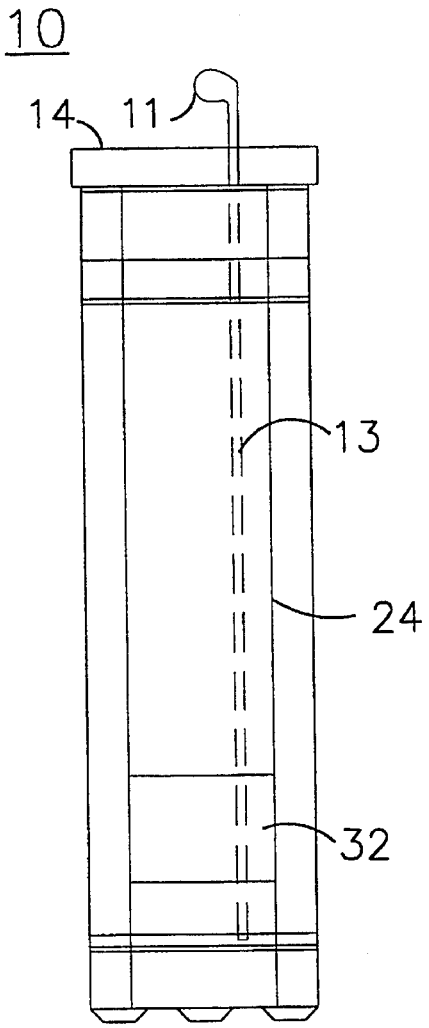
FIG. 1B is a front elevational view of the large golf bag portion of the piggyback golf bag system as shown in FIG. 1A.
Figure 1C:
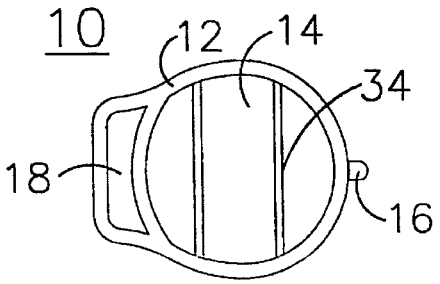
FIG. 1C is a top plan view of the large golf bag portion of the piggyback golf bag system as shown in FIG. 1A.
Figure 1D:
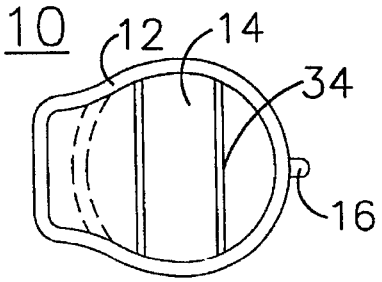
FIG. 1D is a top plan view of an alternate embodiment of the large golf bag portion of the piggyback golf bag system of the present invention as shown in FIG. 1A.

Referring to the drawings, wherein the same reference numerals are used to designate the same elements throughout, there is shown in FIGS. 1A–1D the large golf bag portion 10 of the present invention. The large golf bag portion 10 has a receiving opening 14 at the top for receiving a golf club 11 and an elongated golf bag portion 24 for retaining the elongated shaft 13 of the golf club 11. A number of golf club dividers 34 may be provided within the large golf bag portion 10 in order to separate and organize golf clubs such as the golf club 11 when a number of them are disposed therein. In this manner a number of golf clubs 11 may be organized and retained within the golf bag portion 10. Golf bag portion 10 at 14 is also fitted with a "lip" or protruding portion made to receive the hook or hanging device of second bag for the purpose of joining the two caddy bags. A carrier shoulder strap 16 is provided in order to permit convenient carrying of the large golf bag portion 10 and golf clubs 11.

The large golf bag portion 10 is also provided with a securing device 32 for releasably securing an object to the large golf bag portion 10. The securing device 32 is attached to the outer surface of the large golf bag portion 10. The preferred location of the securing device 32 is the front side at the bottom of the elongated body 24 of the golf bag portion 10, opposite the carrier shoulder strap 16.

In the preferred embodiment of the piggyback golf bag system of the present invention the securing device 32 may be a pressure sensitive securing device such as one of conventional hook and loop material. A common example of this type of pressure sensitive securing device is velcro. However, it will be understood that the securing device 32 may be any convenient device for conveniently securing and releasing an object to the large golf bag portion 10 of the present invention within the scope of the present invention as described hereinbelow.

In addition to the securing device 32 and the shoulder strap 16, the large golf bag portion 10 may be provided with any of the normal features of a conventional golf bag. These features may include, but are not limited to, a zipper pocket 28, a handle 20 and a plurality feet 34 for permitting the large golf bag portion 10 to stand in an upright position.

A mating lip 12 having an opening 18 is also provided on the large golf bag portion 10 for detachably mating the large golf bag portion 10 to form the piggyback golf bag system of the present invention in a manner described hereinbelow. In the preferred embodiment of the large golf bag portion the mating lip 12 is located on the front of the large golf bag portion toward the top of the elongated portion 24. Most preferably the mating lip 12 is located in the vicinity of the receiving opening 14.

Figure 2A:
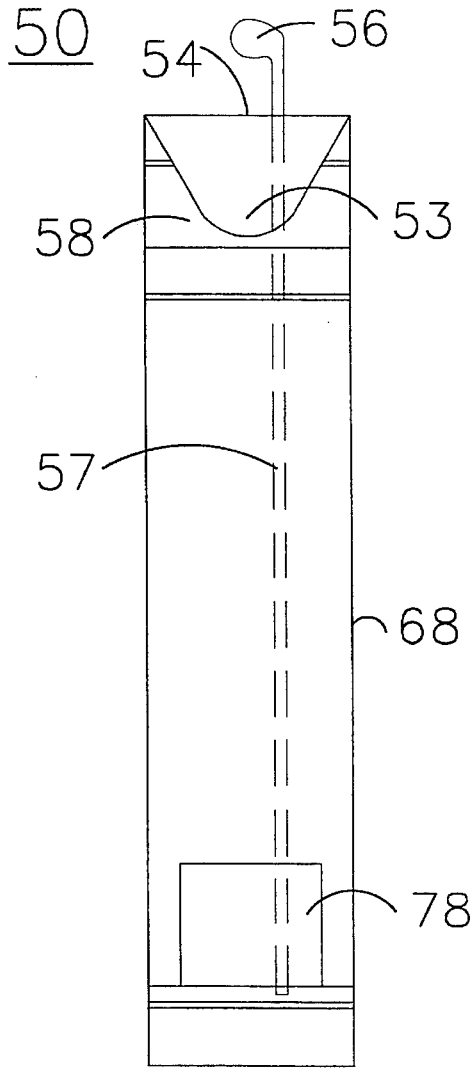
FIG. 2A is a front elevational view of a small golf bag portion of the piggyback golf bag system of the present invention.
Figure 2B:
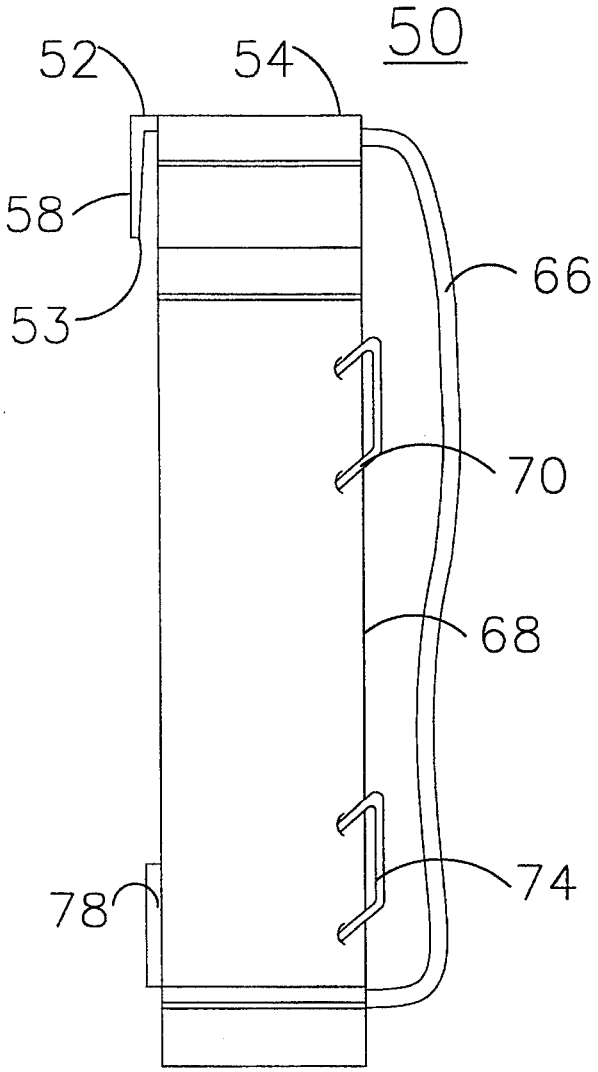
FIG. 2B is a side elevational view of the small golf bag portion of the piggyback golf bag system as shown in FIG. 2A.
Figure 2C:
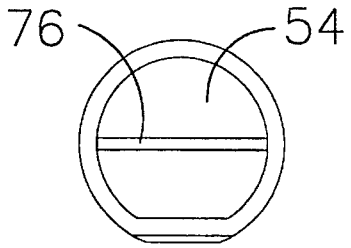
FIG. 2C is a top plan view of the small golf bag portion of the piggyback golf bag system as shown in FIG. 2A.

Referring to FIGS. 2A–2C, there is shown the small golf bag portion 50 of the present invention. The small golf bag portion 50 is provided with a receiving opening 54 for receiving one or more golf clubs 56 and an elongated body portion 68 for retaining the elongated shaft 57 of the golf club 56. On the rear side of the small golf bag portion 50 a shoulder carrying strap 66, an upper handle 70 and a lower handle 74 are provided in order to permit the small golf bag portion 50 to be conveniently carried and handled while it contains a number of golf clubs such as the golf club 56. A golf club divider 76 may be provided within the small bag portion 50 or caddie bag portion 50 in order to separate and organize a number of golf clubs such as the golf club 56.

A mating hook 58 is disposed on the front side of the small golf bag portion 50, opposite the shoulder strap 66 and the handles 70, 74. The mating hook 58 has a laterally extending segment 52 secured at one end to the elongated body portion 68 of the golf bag portion 50. A downwardly extending segment 53 depends from the opposite end of the laterally extending segment 52 and is formed with a triangular shape in the preferred embodiment. The mating hook 58 is preferably located toward the top of the elongated body portion 68 of the small golf bag portion 50. Most preferably the mating hook 58 is located in the vicinity of the receiving opening 54 at the top the small golf bag portion 50.

A releasably securing device 78 is disposed on and securely attached to the small golf bag portion 50 below, preferably on the front side. Thus the mating hook 58 and the securing device 78 are preferably disposed on the same side of the small golf bag portion 50 as each other and on the side opposite the shoulder carrying strap 66. The securing device 78 is preferably a pressure sensitive securing device of the type previously described with respect to the releasably securing device 32.

Figure 3:
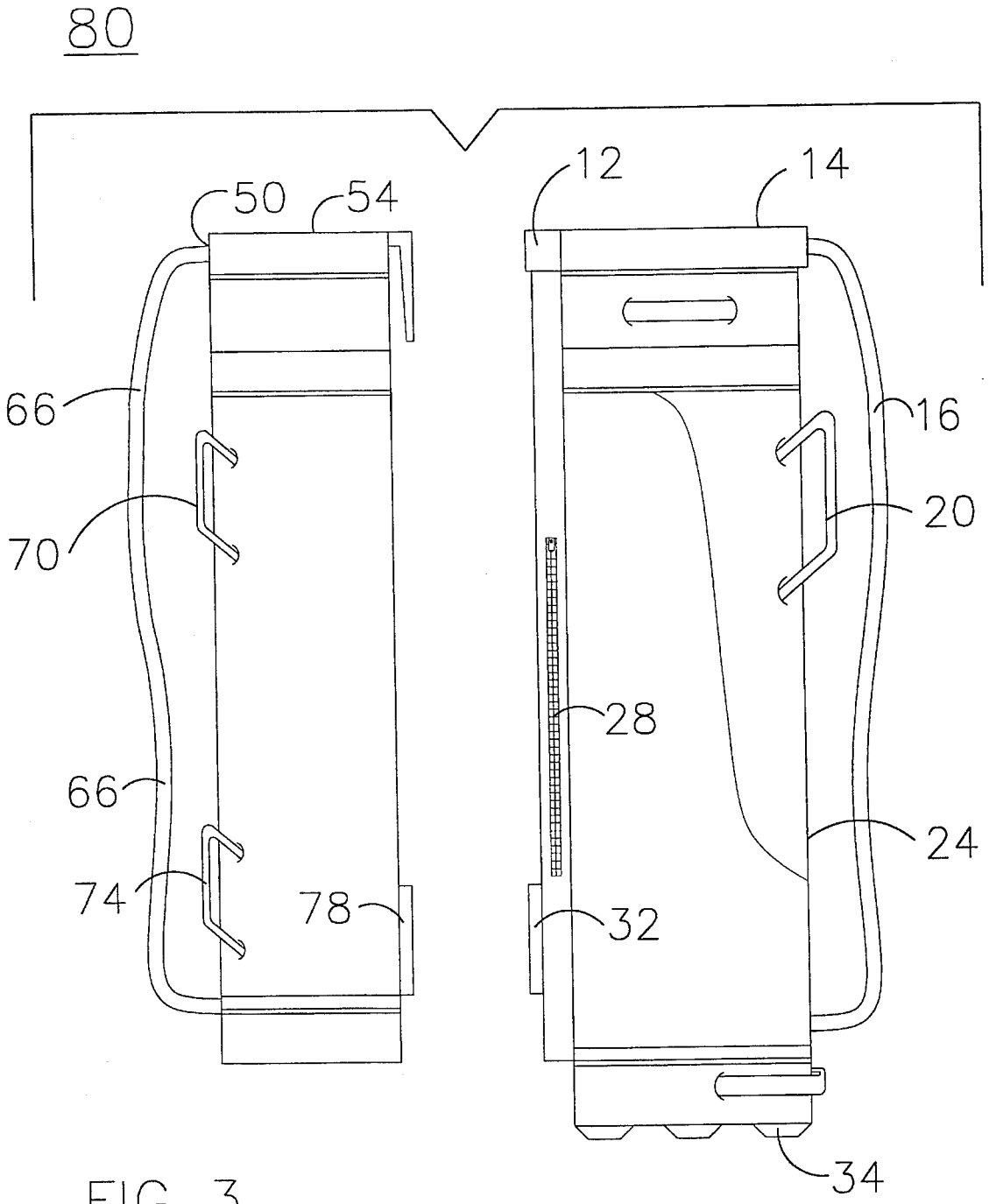
FIG. 3 is a side elevational view of the large golf bag portion of FIG. 1A and the small golf bag portion of FIG. 2A about to be joined together to form the piggyback golf bag system of the present invention.

Referring to FIG. 3, there is shown the piggyback golf bag system 80 of the present invention. The piggyback golf bag system 80 includes the large golf bag portion 10 and the small golf bag portion 50 releasably coupled to each other. The large golf bag portion 10 and the small golf bag portion 50 are releasably secured to each other in the piggyback golf bag system 80 in order to permit them to be conveniently transported together and conveniently separated when the small golf bag portion 50 is to be used to carry golf clubs to a location distant from the large golf bag portion 10.

In order to mate and releasably secure the preferred embodiment of the golf bag portions 10, 50 to each other they are positioned with the fronts of the two golf bag portions 10, 50 facing each other. Using the handles 70, 74 of the small golf bag portion 50, the small golf bag portion is maneuvered to downwardly insert the tip of the downwardly extending segment 53 of the mating hook 58 into the opening 18 of the mating lip 12 of the large golf bag portion 10. The downwardly extending segment 53 is then moved in a downward direction through the opening 18 until the laterally extending segment 52 of the mating hook 58 rests against the mating lip 12.

When the mating hook 58 of the small golf bag portion 50 is mated with the mating lip 12 of the large golf bag portion 10 in this manner, the golf bag portions 10, 50 may be rotated with respect to each other about a pivot formed by the mating hook 58 and the mating lip 12. In this manner the small golf bag portion 50 may be pivoted toward the large golf bag portion 10 to bring the lower regions of the fronts of the golf bag portions 10, 50 into contact with each other. In the preferred embodiment of the piggyback golf bag system 80 the securing devices 32, 78 are disposed on the fronts of the golf bag portions 10, 50 at locations such that the pivoting action brings them into contact with each other whereby they may be releasably secured to each other.

In order to perform the mating operation, the handles 70, 74 of the small golf bag portion 50 may first be separately grasped, one in each hand, to lift the small golf bag portion 50 and maneuver the tip of the downwardly extending segment 53 to the opening 18 of the mating lip 12 for insertion therethrough. It will be understood that the weight of the small golf bag portion 50 and its contents must be supported during the positioning process. Therefore, in order to facilitate this insertion, the opening of the mating lip 12 should be wide enough to permit easy insertion of the downwardly extending segment 53 without an undue amount of care about the positioning of the tip of the downwardly extending segment 53. Also, the hook 53 should be a triangular shape to facilitate insertion.

Figure 8:
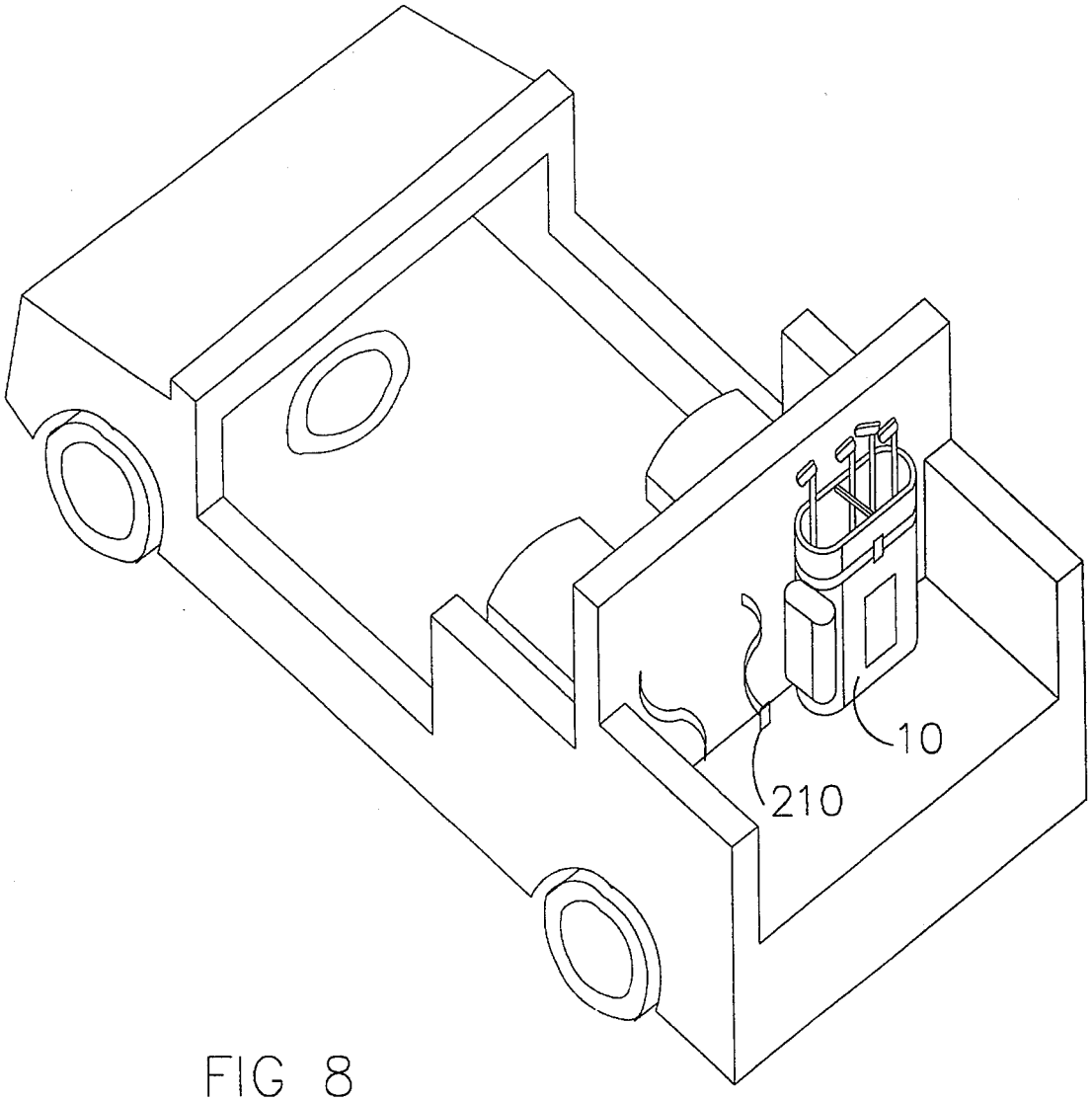
FIG. 8 is a perspective view of the large golf bag portion of the present invention as shown in FIG. 1A secured to a golf cart.
Figure 9:
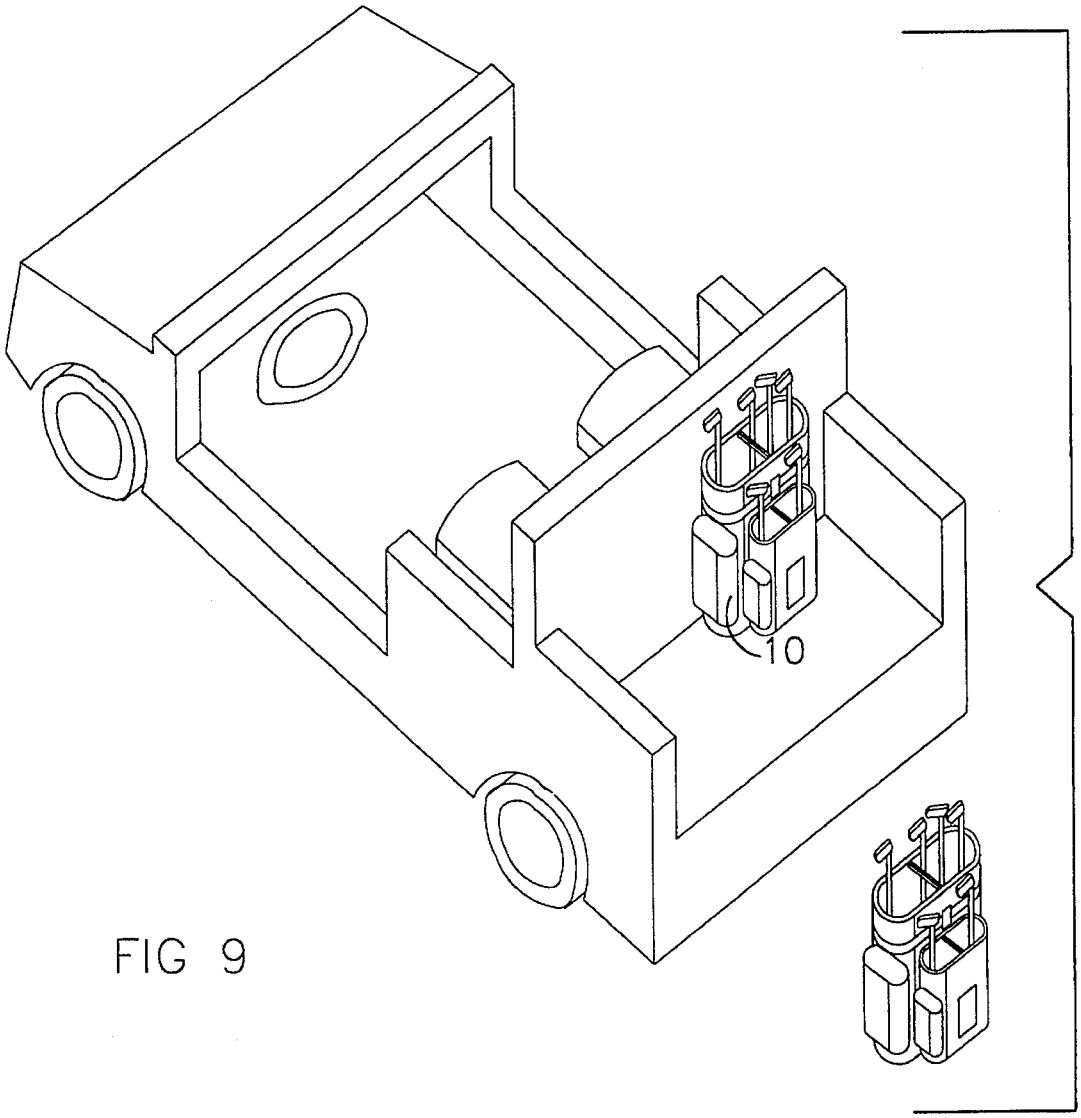
FIG. 9 is a perspective view of a riding golf cart containing the piggyback golf bag system as shown in FIG. 2A.

When the mating hook 58 and the mating lip 12 are joined in this manner the small golf bag portion 50 is pivoted as previously described or held away at the bottom by the lower handle. This pivoting is primarily under the control the lower handle 74 of small bag portion 50. However, before and during pivoting the bottom of the small bag portion may be held away from the large bag portion 10 by the lower handle 74 or by the user's hand. After the pivoting is complete to bring the securing device 78 of the small golf bag portion 50 into contact with the releasably securing device 32 of the large caddie bag portion 10, the golf bag portions 10, 50 may be simultaneously supported upon the feet 34 of the large golf bag portion 10. Additionally, the golf bag portions 10, 50 may be transported in a mated configuration by a golf cart 200 (FIG. 8) while the large golf bag portion 10 is secured to the rear of the golf cart 200 by a golf cart attachment device 210 as shown in FIG. 8. The golf cart attachment device 210 may be a strap or any other conventional device for securing a golf bag 10 to the rear of a golf cart 200.

Figure 4B:
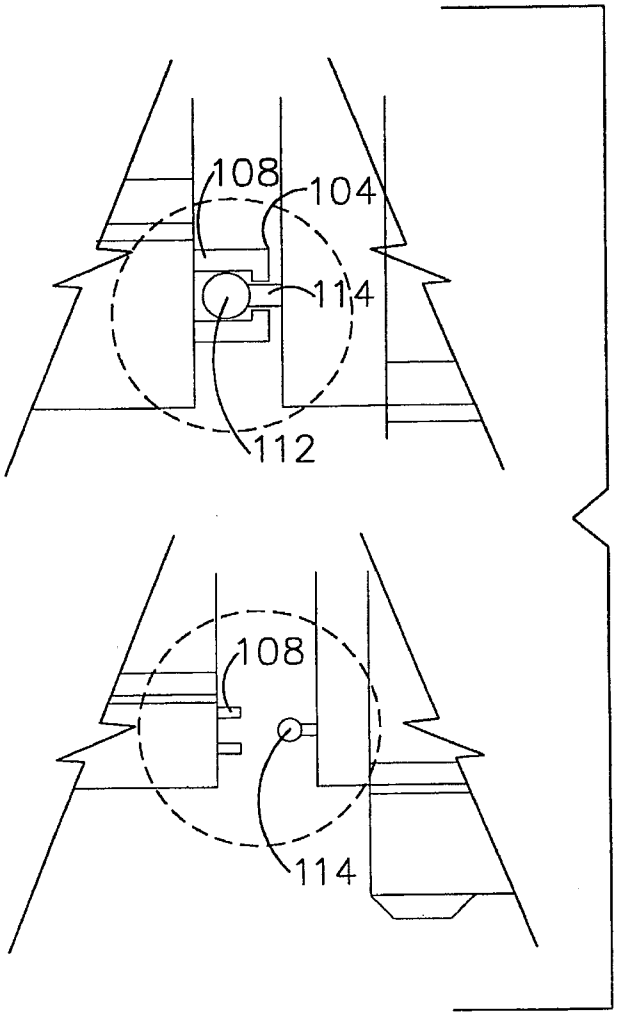
FIGS. 4A, 4B are side elevational views of an alternate embodiment of the piggyback golf bag system as shown in FIG. 3.
Figure 4A:
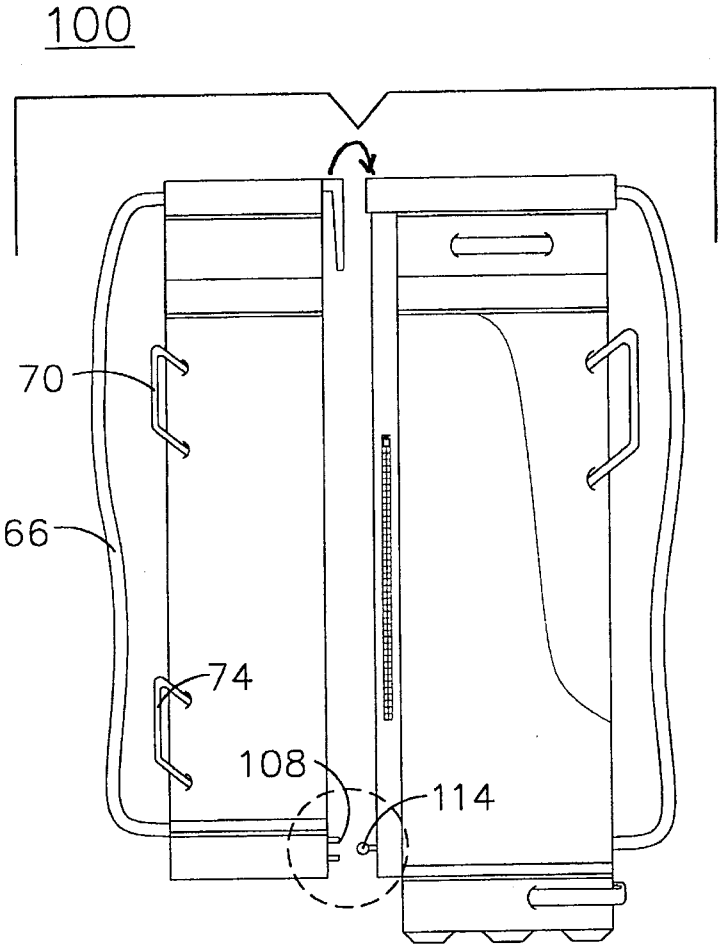

Referring to FIGS. 4A,B, there is shown the piggyback golf bag system 100. The piggyback golf bag system 100 is an alternate embodiment of the piggyback golf bag system 80. In addition to the mating hook 58 and the mating lip 12 as previously described, an attachment device 104 rather than the releasably securing devices 32, 78, is provided in the golf bag system 100 for detachably securing the large golf bag portion 10 to the small golf bag portion 50.

The attachment device 104 of the piggyback golf bag system 100 includes a conventional spring latch wherein spaced apart outwardly extending resilient arms 108 are resiliently spread apart from each other by a ball 112 as a rod 114 thrusts the ball 112 into the space between the arms 108. Thus, within the piggyback golf bag system 100 the handles 70, 74 are grasped to insert the downwardly extending segment 53 of the mating hook 58 into the opening 18 of the mating lip 12 until the laterally extending segment 52 rests against the mating lip 12 as previously described. Then, primarily using the handle 74, the small golf bag portion 50 is pivoted to thrust the ball 112 of the attachment device 104 between the resilient arms 108 until the arms 108 resiliently spring back and secure the ball 112 and supporting rod 114.

Figure 5A:
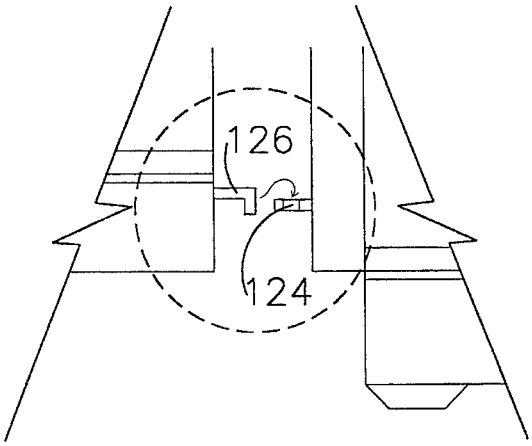
FIGS. 5A–5C are fragmentary views of an alternate embodiment of the piggyback golf bag system as shown in FIG. 3.
Figure 5C:
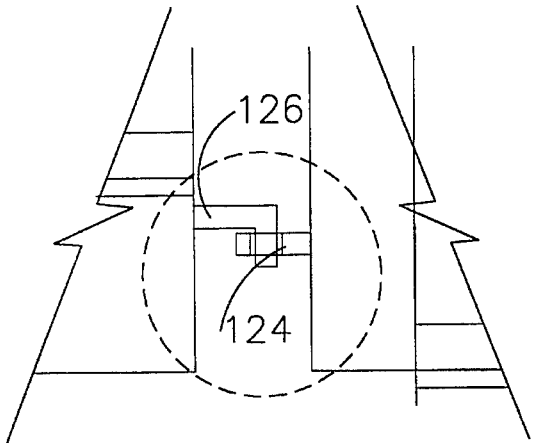
Figure 5B:
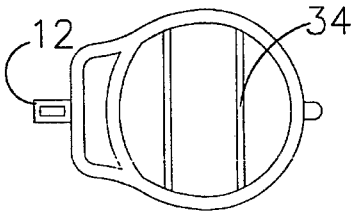

Referring to FIGS. 5A–C, there is shown a further attachment device 120. The attachment device 120 is an alternate embodiment of the pressure sensitive attachment devices 32, 78 and the attachment device 104 for use in detachably securing the large golf bag portion 10 and the small golf bag portion 50 to each other within the piggyback golf bag system of the present invention. The attachment device 120 is a conventional hook and eyelet system, wherein an eyelet 124 is disposed on the front surface of the large golf bag portion 50 and a downwardly extending hook 126 is disposed on the small golf bag portion 50.

When detachably securing the small golf bag portion 50 to the large golf bag portion 10 using the hook and eyelet attachment device 120, the handles 70,74 are grasped and the tip of the downwardly extending segment 53 of the mating hook 58 is moved to the vicinity of the opening 18 of the mating lip 12 on the large golf bag portion 10. The small golf bag portion 50 is then lowered to permit the downwardly extending segment 53 to move through the opening 18 of the mating lip 12 until the tip of the hook 126 is in the vicinity of the eyelet 124. The small golf bag portion 50 is then maneuvered using handles 70, 74 to cause the hook 126 to mate with the eyelet 124.

While a limited number of latching, hooking and adhering methods are shown herein for securing the upper and lower regions of the small golf bag portion 50 and the large golf bag portion 10 to each other, it will be understood that any method for detachably securing them is believed to be within the scope of the invention and a matter of design choice. Other methods for mating the top and bottom regions of the golf bag portions 10, 50 may include, but are not limited to wrap around straps having buckles and straps having hook and loop material at the top as well as at the bottom. Additionally, any type of clamping device may be used. When the securing golf bag portions 10, 50 to each other to form the piggyback golf bag system of the present invention, the male and female elements forming the various releasable attachment devices may be disposed on either golf bag portion 10, 50 and at varying locations along the elongated regions 24, 68 of the golf bag portions 10, 50.

Figures 6A, 6B:
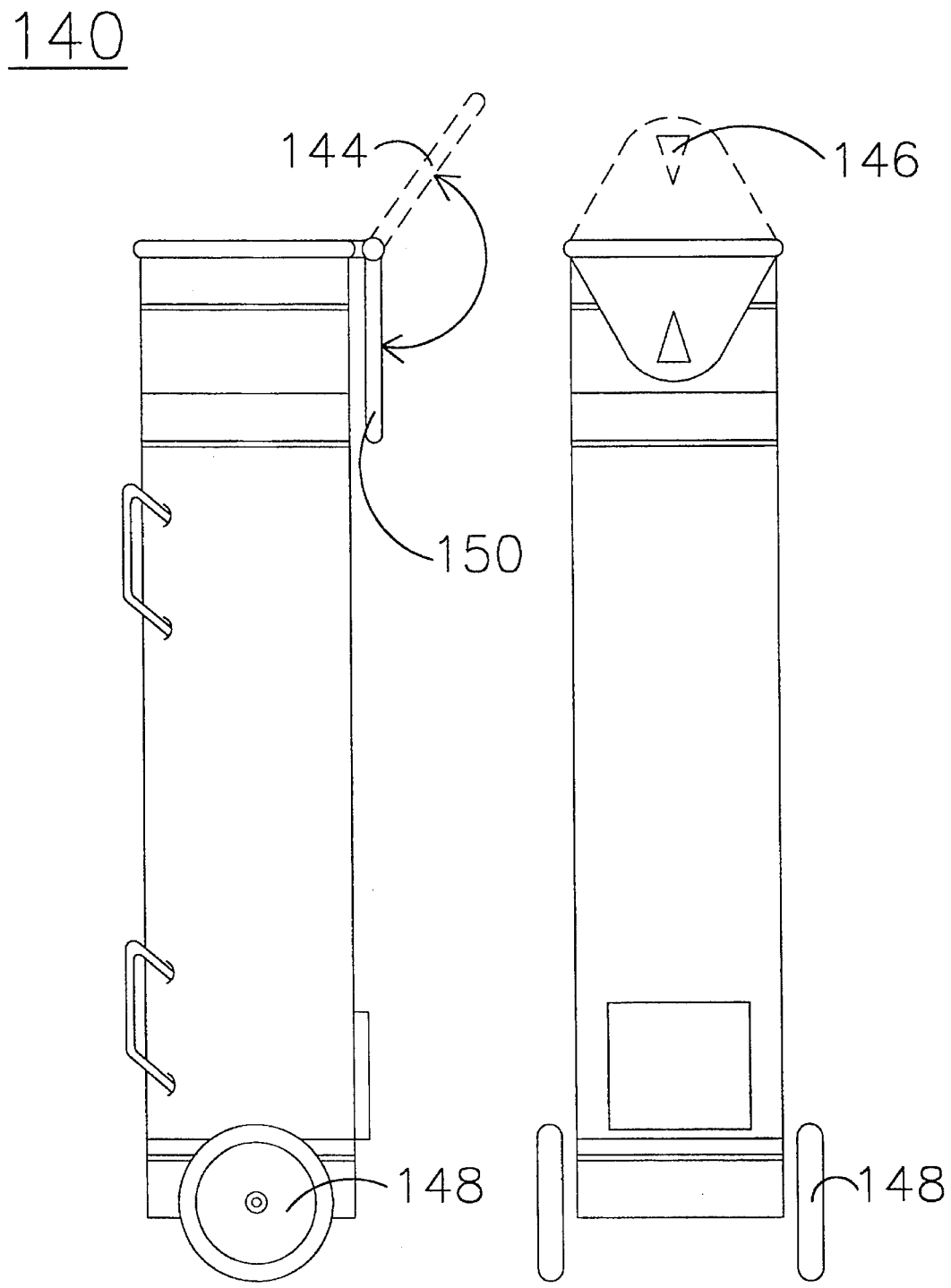
FIG. 6A is a side elevational view of an alternate embodiment of the small golf bag portion as shown in FIG. 2A.
FIG. 6B is a front elevational view of the alternate embodiment of the small golf bag portion as shown in FIG. 6A.

Referring to FIGS. 6A,B, there is shown a small golf bag portion 140. The small golf bag portion 140 is an alternate embodiment of the small golf bag portion 50. The small golf bag portion 140 is provided with an articulating hook 144. In the articulating hook 144 of the small bag portion 140, a rotatable segment 150 is hinged with respect to an outwardly extending top segment 52. When the rotatable segment 150 is rotated into its downward mating position, it is disposed for mating with the opening 18 of the mating lip 12 as previously described. When the rotating segment 150 is rotated to its upward position (shown in phantom), it may be grasped through an opening 146 to pull the small golf bag portion 140 along a surface using the wheels 148 on the lower region of the small golf bag portion 140 in order to conveniently transport the small golf bag portion 140.

Figures 7A, 7B, 7C:
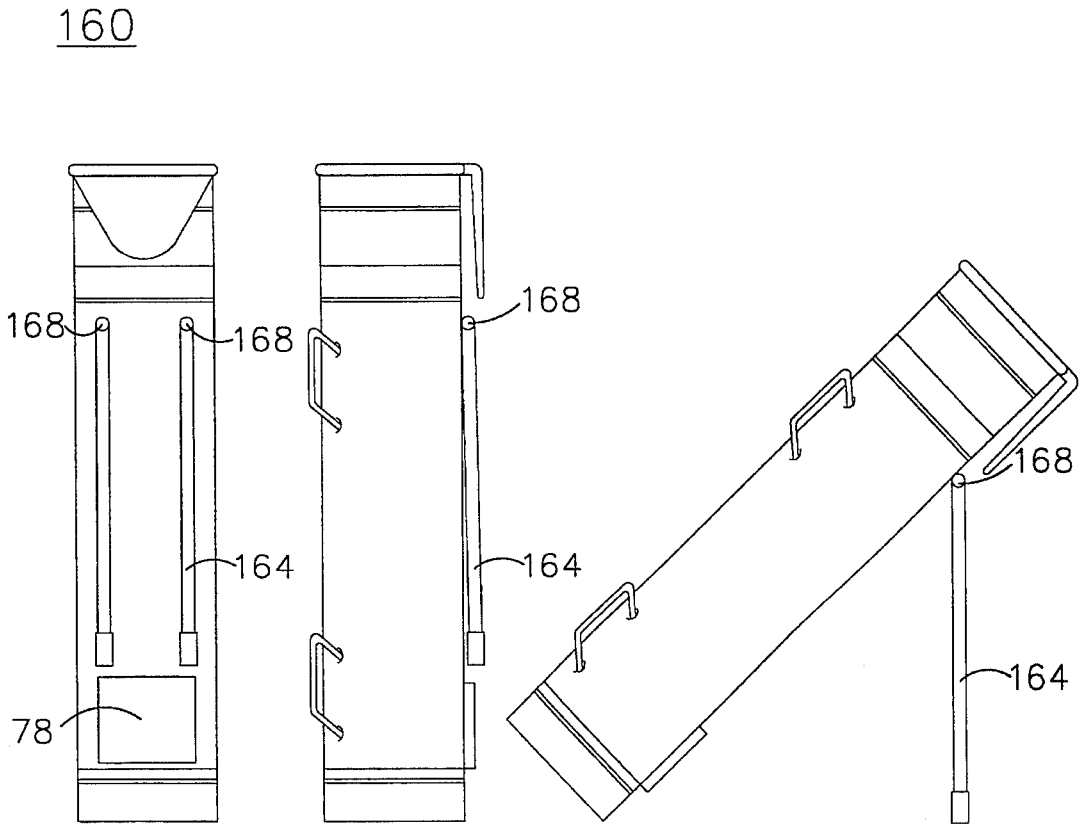
FIG. 7A is a front elevational view of an alternate embodiment of the small golf bag portion as show in FIG. 2A.
FIG. 7B is a side elevational view of the alternate embodiment of the small golf bag portion as shown in FIG. 7A.
FIG. 7C is a side elevational view of the alternate embodiment the small bag portion as shown in FIG. 7A disposed in a swing-out position.

Referring to FIGS. 7A–7C, there is shown a small golf bag portion 160. The small golf bag portion 160 is a further alternate embodiment of the small golf bag portion 50. Within the small golf bag portion 160 a number of tripod legs 164 are pivotally secured to the elongated portion 68 by hinges 168. The small golf bag portion 160 may be transported, while containing the golf club 56, in the manner previously described or by any other convenient method. When the small golf bag portion 160 is no longer being transported, for example when a user is hitting a ball, the tripod legs 164 may be rotatably extended to provide a support means for holding the small golf bag portion 160 in a semi-upright position.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A piggyback golf bag system for use with a riding golf cart having a golf cart attachment device for attaching said golf bag system to said golf cart, comprising:

a first golf bag portion having an opening for receiving a first golf club and an elongated body portion for retaining said first golf club;

a second golf bag portion, separate from said first golf bag portion, having an opening for receiving a second golf club and an elongated body portion for retaining said second golf club; and a golf bag attachment device unreleasably attached to one of said first and second golf bag portions and separate from said riding golf cart and operative to detachably secure said first and second golf bag portions to each other.

2. The piggyback golf bag system according to claim 1, wherein said golf bag attachment device comprises a pressure sensitive securing device.

3. The piggyback golf bag system according to claim 1, wherein said golf bag attachment device comprises hook and loop material.

4. The piggyback golf bag system according to claim 1, wherein said golf bag attachment device comprises a latching device.

5. The piggyback golf bag system according to claim 1, wherein said golf bag attachment device comprises a resilient attachment device.

6. The piggyback golf bag system according to claim 1, wherein said golf bag attachment device comprises a hook.

7. The piggyback golf bag system according to claim 6, wherein said golf bag attachment device comprises two hooks.

8. The piggyback golf bag system according to claim 1, wherein said golf bag attachment device comprises a strap.

9. The piggyback golf bag system according to claim 1, wherein said first and second golf bag portions are formed of a pliable water-resistant material.

10. The piggyback golf bag system according to claim 1, wherein said first golf bag portion is divided into a plurality of compartments.

11. The piggyback golf bag system according to claim 10, wherein said second golf bag portion is divided into a plurality of compartments.

12. The piggyback golf bag system according to claim 11, wherein said compartments are elongated and operative to receive and contain said golf clubs.

13. The piggyback golf bag system according to claim 1, wherein said first and second golf bag portions are formed with differing lengths and at least one golf bag portion of said first and second golf bag portions is provided with wheels for moving the shorter golf bag portion over a surface.

14. The piggyback golf bag system according to claim 1, wherein said golf bag attachment device comprises an articulating hook said hook being rotatable into a position for use as a handle to pull a golf bag portion of said first and second golf bag portions over a surface.

15. The piggyback golf bag system according to claim 1, further comprising a first carrier strap disposed upon said first golf bag portion for separately carrying said first golf bag portion when said first golf bag portion is detached from said second golf bag portion.

16. The piggyback golf bag system according to claim 15, further comprising a second carrier strap disposed on said second golf bag portion for separately carrying said second golf bag portion when said second golf bag portion is detached from said first golf bag portion.

17. The piggyback golf bag system according to claim 1, wherein said first and second golf bag portions are secured to said golf cart by means of said golf cart attachment device.

18. The piggyback golf bag system according to claim 1, wherein said golf bag attachment device comprises a mating hook and lip.

19. The piggyback golf bag system according to claim 18, wherein said mating hook and lip are disposed on upper regions of said first and second golf bag portions.

20. The piggyback golf bag system according to claim 19, wherein said hook of said mating hook and lip is disposed on a smaller golf bag portion of said first and second golf bag portions.

21. The piggyback golf bag system according to claim 1, wherein said golf bag attachment device is disposed upon at least one of said first and second golf bag portions.

22. A piggyback golf bag system for use with a riding golf cart having a golf cart attachment device for attaching said golf bag system to said riding golf cart, comprising:

a first golf bag portion having an opening for receiving a first golf club and an elongated body portion for retaining said first golf club;

a second golf bag portion, separate from said first golf bag portion, having an opening for receiving a second golf club and an elongated body portion for retaining said second golf club; and a golf bag attachment device formed of a hook and loop material for detachably securing said first and second golf bag portions to each other.

23. The piggyback golf bag system according to claim 22, wherein said first and second golf bag portions are of differing lengths and at least one golf bag portion of said first and golf bag portions is provided with wheels for moving over a surface.

24. The piggyback golf bag system according to claim 22, further comprising an articulating hook for rotating into a position for use as a handle to pull a golf bag portion of said first and second golf bags over a surface.

25. The piggyback golf bag system according to claim 22, comprising a mating hook and lip.

26. The piggyback golf bag system according to claim 25, wherein said mating hook and lip are disposed on upper regions of said first and second golf bag portions.

27. The piggyback golf bag system according to claim 25, wherein said hook of said mating hook and clip is disposed on a smaller golf bag portion of said first and second golf bag portions.

28. A piggyback golf bag system for use with a riding golf cart having a golf cart attachment device for attaching said golf bag system to said riding golf cart, comprising:

a first golf bag portion having an opening for receiving a first golf club and an elongated body portion for retaining said first golf club;

a second golf bag portion, separate from said first golf bag portion, having an opening for receiving a second golf club and an elongated body portion for retaining said second golf club; and a golf bag attachment device for detachably securing said first and second golf bag portions to each other, said first and second golf bag portions being of differing lengths and at least one golf bag portion of said first and second golf bag portions being provided with wheels for moving over a surface, said golf bag attachment device including an articulating hook rotatable into a position for use as a handle to pull a golf bag portion of said first and second golf bag portions over said surface.

29. The piggyback golf bag system according to claim 28, wherein said golf bag attachment device further comprises a pressure sensitive securing device.

30. The piggyback golf bag system according to claim 28, wherein said golf bag attachment device further comprises a hook and loop material.

31. The piggyback golf bag system according to claim 28, wherein said golf bag attachment device further comprises a latching device.

32. The piggyback golf bag system according to claim 28, wherein said golf bag attachment device further comprises a resilient attachment device.

33. The piggyback golf bag system according to claim 28, wherein said golf bag attachment device further comprises a hook.

34. The piggyback golf bag system according to claim 28, wherein said golf bag attachment device further comprises a strap.

35. The piggyback golf bag system according to claim 28, wherein said golf bag attachment device further comprises a mating hook and lip.

36. The piggyback golf bag system according to claim 35, wherein said mating hook and lip are disposed on upper regions of said first and second golf bag portions.

37. A piggyback golf bag system for use with a riding golf cart having a golf cart attachment device for attaching said golf bag system to said golf cart, comprising:

a first golf bag portion having an opening for receiving a first golf club and an elongated body portion for retaining said first golf club;

a second golf bag portion, separate from said first golf bag portion, having an opening for receiving a second golf club and an elongated body portion for retaining said second golf club; and a mating hook and lip golf bag attachment device for detachably securing said first and second golf bag portions to each other.

38. The piggyback golf bag system according to claim 37, wherein said attachment device further comprises a hook and loop.

39. The piggyback golf bag system according to claim 37, wherein said attachment device further comprises a latching device.

40. The piggyback golf bag system according to claim 37, wherein said attachment device further comprises a resilient attachment device.

41. The piggyback golf bag system according to claim 37, wherein said attachment device further comprises a strap.

42. The piggyback golf bag system according to claim 37, wherein said first and second golf bag portions are of differing lengths and at least one golf bag portion of said first and second golf bag portions is provided with wheels for moving over a surface.

43. The piggyback golf bag system according to claim 37, wherein said golf bag attachment device comprises an articulating hook rotatable into a position for use as a handle to pull a golf bag portion of said first and second golf bag portions over a surface.

44. The piggyback golf bag system according to claim 37, wherein said hook of said mating hook and lip golf bag attachment device is disposed on a smaller golf bag portion of said first and second golf bag portions.

* * * * *